United States Patent [19]

Woods

[11] 4,211,445

[45] Jul. 8, 1980

[54] SOAP BAR HOLDER

[76] Inventor: Ivan D. Woods, 18119-3 Camino Bello, Rowland Heights, Calif. 91745

[21] Appl. No.: 937,595

[22] Filed: Aug. 28, 1978

[51] Int. Cl.[2] ..... A47G 35/00

[52] U.S. Cl. ..... 294/25; 294/64 R

[58] Field of Search ..... 294/25, 64; 248/206 R, 248/362; 401/88; D28/73–99

[56] References Cited

U.S. PATENT DOCUMENTS

| | | | |
|---|---|---|---|
| D. 211,888 | 8/1968 | Hall et al. | D33/24 |
| 2,734,766 | 2/1956 | Envoldsen | 294/25 |
| 3,542,411 | 11/1970 | Filas | 294/64 R |
| 3,697,111 | 10/1972 | Thompson | 294/64 R |

*Primary Examiner*—James B. Marbert

*Attorney, Agent, or Firm*—Christie, Parker & Hale

[57] ABSTRACT

A soap bar holder comprises a flexible soap-holding pad having mutually spaced apart resilient suction cups for securing the pad to a soap bar. The soap-holding pad can have a friction surface adjacent the suction cups for penetrating the soap bar to prevent slippage of the soap bar relative to the pad. A stop pad for overlying the back of the fingers is secured to one end of an elongated flexible stem extending away from a face of the soap-holding pad opposite the suction cups. The flexible stem and the stop pad securely hold the soap-holding pad and soap bar in the hand of a user. The flexible stem can extend between a pair of adjacent fingers on the user's hand, and the stem is sufficiently flexible that the soap-holding pad can be moved longitudinally and laterally relative to the stop pad to flex in any direction to allow the soap-holding pad and the soap bar to be held in a variety of positions in the user's hand.

20 Claims, 5 Drawing Figures

SOAP BAR HOLDER

BACKGROUND

This invention relates to soap bar holders.

A soap bar holder generally comprises a device for being pressed against a bar of soap and secured to the hand of a user so that the bar of soap does not slip out of the user's hand when he or she is showering or bathing. The present invention provides an improvement over previous soap bar holders, such as those disclosed in the following patents:

| U.S. Pat. No. | Patentee |
|---|---|
| 1,941,320 | Pamplin |
| 2,466,502 | Stiller |
| 2,900,757 | Grimm, Jr. |
| 3,123,832 | Kubik |
| 3,288,105 | Staver |
| 3,697,111 | Thompson |

Prior art soap bar holders suffer from a number of disadvantages. Some soap bar holders are too complicated or costly. Some are so large or bulky that the bar of soap cannot be comfortably grasped by hand. Many soap bar holders slip relative to a soap bar when the soap bar is wet. Many soap bar holders also do not conform well to the various shapes and sizes of soap bars on the market and therefore are unable to attach securely to many common soap bars. Many soap bar holders also are not sufficiently adaptable for allowing the user to hold a soap bar in a variety of positions in the hand, or for allowing different users having different hand sizes to all comfortably grasp the bar of soap.

The present invention provides an improved soap bar holder which overcomes all of these disadvantages.

SUMMARY OF THE INVENTION

This invention provides a soap bar holder comprising a flexible soap-holding pad, a plurality of mutually spaced apart resilient suction cups on a first face of the soap-holding pad, an elongated laterally flexible, narrow stem having a first end secured to a second face of the soap-holding pad opposite the first face thereof, and a stop pad secured to the second end of the stem opposite the first end thereof.

The suction cups can be pressed against a bar of soap for securing the soap-holding pad to the soap bar. The narrow stem can fit between a pair of adjacent fingers on the user's hand, and the stop pad can overlie the back of the user's fingers for use in securely holding the soap bar in the user's hand. The stem has sufficient lateral flexibility to allow the user to hold the soap in any of a number of desired positions in his or her hand. The flexible soap-holding pad can easily conform to various shapes and sizes of soap bars on the market, and the soap-holding pad can be sufficiently thin and of relatively small enough size that it occupies a minimum of space and allows the user to easily grasp the soap bar in his hand. The structure of the soap bar holder facilitates relatively simple and inexpensive manufacture from a single integral flexible piece of material, such as a resiliently flexible plastic material. The soap-holding pad can have a friction surface adjacent the suction cups for penetrating the soap bar to prevent slippage of the soap bar relative to the pad.

These and other aspects of the invention will be more fully understood by referring to the following detailed description and the accompanying drawing.

DRAWING

DETAILED DESCRIPTION

Figure 1:
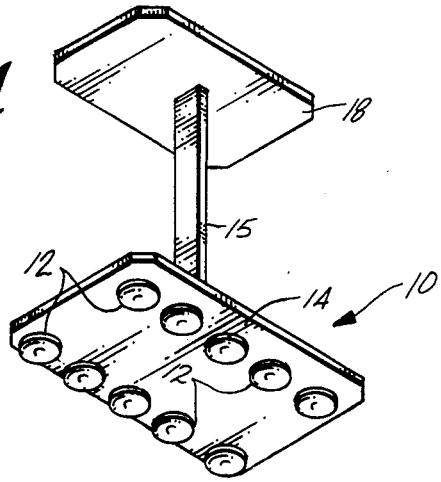
FIG. 1 is a perspective view showing a soap bar holder according to principles of this invention.

Referring to FIG. 1, a soap bar holder comprises a relatively thin and flat transversely flexible soap-holding pad 10. A plurality of mutually spaced apart suction cups 12 project away from a first flat face 14 of the soap-holding pad. The suction cups are in a pair of parallel rows. FIG. 1 shows five suction cups per row, although the number of suction cups per row can vary. Preferably, the rows of suction cups are spaced apart by either 11/16 inch or by about one inch. The suction cups open away from the first face 14 of the pad 10. A narrow, elongated, laterally flexible stem 15 has a first end integrally formed with a second flat face 16 of the pad opposite the first face 14 of the pad. An elongated relatively thin and flat transversely flexible stop pad 18 is integrally formed with a second end of the stem remote from the soap-holding pad. The stem 15 extends perpendicularly between the soap-holding pad 10 and the stop pad 18. The soap-holding pad and the stop pad lie in respective planes which are substantially parallel to one another.

Figure 3:
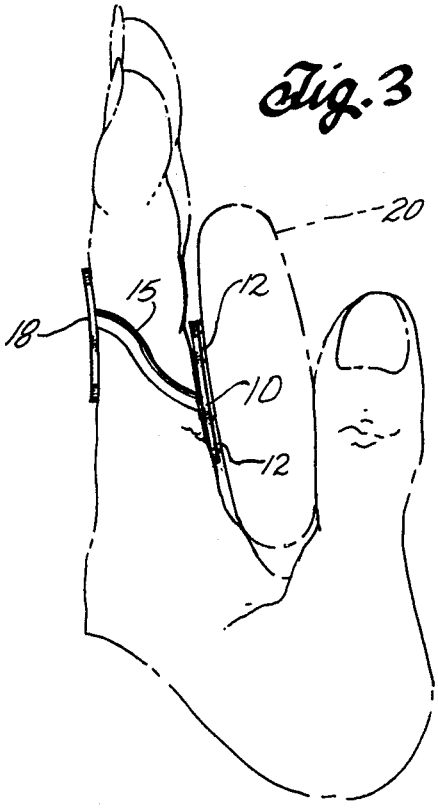
FIG. 3 is an end elevation view taken on line 3—3 of FIG. 2 and showing the soap bar holder in use.

In using the soap-bar holder, as shown in FIG. 3, the suction cups 12 are pressed against the face of a soap bar 20 permitting the suction cups to be flattened against the face of the soap bar to provide suction for adhering the soap bar to the soap-holding pad. The suction provided by the suction cups can in some instances secure the pad to a moistened soap bar, although if the soap bar is slippery, the embodiment of FIGS. 4 and 5 can hold the pad in securely to the soap bar. The suction is sufficient that in terms of supporting the weight of a soap bar, the pad can remain attached to the soap bar even when the soap bar has dried and when the soap bar is freely suspended from below the pad, whether the soap bar is a new bar of say 7¾ ounces in weight, or a wafer thin used bar.

The stem 15 is slipped between a pair of adjacent fingers on the hand of a user, and the soap bar is then grasped by the hand of the user, say in the palm of the hand. The stop pad 18 can bear against the back side of the user's finers to prevent the soap bar from slipping out of the user's hand if he or she lets go of the soap bar. The stem 15 is sufficiently flexible laterally that the soap bar can be moved around in the user's hand to any desired position. FIG. 3 shows one example in which the flexibility of the stem 15 allows the soap bar to be slid downwardly, relative to the position of the stop pad 18, so that the soap bar can be firmly grasped and held in the palm of the hand. The stem 15 also is sufficiently flexible and sufficiently long that the soap bar shown in FIG. 3 can be moved laterally crosswise in the hand of the user illustrated in FIG. 3.

Thus, the soap holder of this invention provides a flexible soap-holding pad which, owing to its flexibility and the suction cups 12, can conform to a wide variety of shapes and sizes of soap bars. In one embodiment of the invention, the pad 14 is smaller than the size of all new bars of popular soaps so that the fingers and thumb of the user's hand are able to slip around the sides of the bar of soap to obtain a firm grip.

Figure 2:
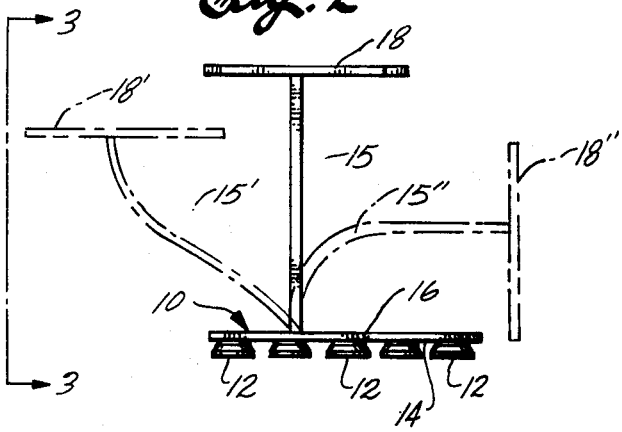
FIG. 2 is a front elevation view of the soap bar holder.

FIG. 2 best illustrates the lateral flexibility of the stem 15. The stem has sufficient structural integrity that it can remain in a free-standing position, as shown in FIG. 2 when unsupported, and yet the stem has sufficient flexibility that the soap-holding pad 14 can be moved longitudinally relative to the position of the stop pad shown at 18', as well as being able to move the soap-holding pad laterally with respect to the stop paid 18, as illustrated in FIG. 3. The stem can be flexed sufficiently, as shown at 15" in FIG. 2, such that at least a portion of the stop pad can be moved into the plane of the soap-holding pad, as illustrated by the position of the stop pad at 18" in FIG. 2.

Preferably, the stem is about one to 1¾ inches long and has a narrow dimension of about 1/16 inch and a wider dimension of about ¼ to 5/16 inch. These dimensions provide sufficient flexibility or freedom of movement of the soap-holding pad relative to the stop pad that the bar of soap can be positioned in a variety of different positions in the user's hand, as well as being adaptable to users having diffierent hand sizes. At the juncture of the stem 15 and the second face 16 of the soap pad, the stem can be necked down for providing an increase in the flexibility of the base of the stem relative to the soap-holding pad 10.

In the embodiment shown, the stem 15 is offset longitudinally from the center of the soap-holding pad so that a major portion of the length of the pad extends away from one side of the stem, as shown best in FIG. 2. This provides means for allowing the soap-holding pad to be freely moved to reach any comfortable position with respect to either of the user's hands when the stem extends between the first and second fingers of the hand.

In one embodiment, the soap-holding pad is about 1⅞ inches long and about one inch wide. The suction cups 12 have a diameter of about ⅛ inch and there are two parallel rows of suction cups, with the spacing between rows being greater than the spacing between the cups in each row. In one embodiment, the suction cups in one row are spaced about 11/16 inch from the cups of the other row. Alternatively, the rows can be spaced apart by about one inch, in which case the pad 10 can be about 1¾ inches long and 1¼ inches wide. Either of these arrangements has been found to provide means for securely attaching the soap-holding pad to a large number of shapes and sizes of soap bars, especially those having embossments, or other surfaces irregularities, which otherwise can make it difficult to secure a soap-holding pad to the bar of soap. These arrangements can facilitate attaching the pad to all of the 19 soap bars presently responsible for over 90% of the sales of hand soap. In the embodiment shown, there are five circular suction cups each row, although the number of cups in each row can vary from one or more per row. The individual cups also can be elongated with rounded ends, if desred, in which case fewer cups per row can be used.

The soap holder of this invention improves the ability of different users having different hand sizes to easily grasp a bar of soap, owing to the minimal spacing between the rear face 16 of the soap-holding pad and the surface of the bar of soap to which the pad is secured. Preferably, the soap-holding pad is as thin as possible, and in one embodiment the soap-holding pad is not more than about ⅛ inch thick and more preferably, about 1/16 inch thick. Moreover, the suction cups are sufficiently resilient that when pressed against the face of a soap bar, they flatten out to a thickness of about 0.030 inch as viewed in FIG. 3.

The present invention facilitates manufacture from a single injection molded resilient plastic material, and as a result, the soap holder can be relatively simple and inexpensive to manufacture.

Figure 4:
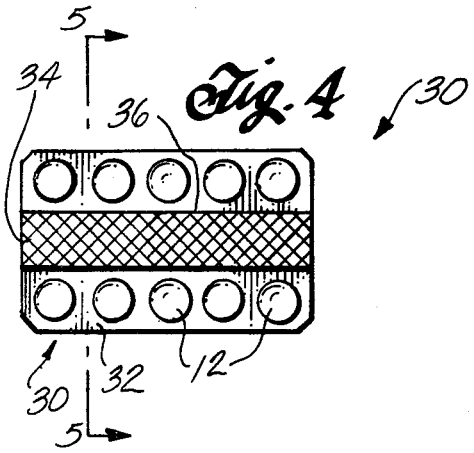
FIG. 4 is a bottom plan view showing an alternate form of the soap bar holder having a friction surface for penetrating a soap bar.
Figure 5:
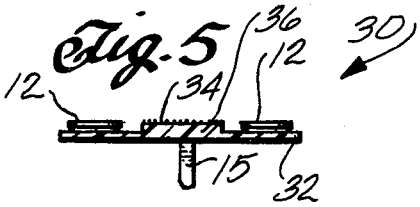
FIG. 5 is a cross-sectional view taken on line 5—5 of FIG. 4.

FIGS. 4 and 5 show an alternate form of the invention having a soap-holding pad 30 with a high friction surface adjacent the suction cups for use in keeping the pad in place on a slippery bar of soap. The pad 30 includes a pair of parallel, thin outer strips 32 for supporting the rows of suction cups 12. A central strip 36 of greater thickness extends between the rows of suction cups, and a high friction surface 34 is formed on the side of the central strip which faces toward the suction cups. Alternatively, the high friction surface can extend between adjacent suction cups. The high friction surface is provided by a material having a roughened surface. The high friction layer is transversely flexible, i.e., it is able to flex or bend with corresponding bending or flexing of the pad. The material can comprise rows of thin projections integrally formed as a lattice work on the surface of the central strip, as illustrated in FIG. 5. Alternatively, the high friction surface can comprise a separate highly flexible and thin strip of plastic mesh material, such as fiberglass mesh secured to the central stip 36 by an intervening highly flexible and thin adherence layer (not shown). The adherence layer can be adhesively bonded between the central strip and the fiberglass strip. The roughened friction surface 34 adapts to the shape of any soap bar and the strands or projections in the roughened layer penetrate and become embedded in the soap bar to obtain a firm grip on the soap bar, even when the soap bar is slippery, to prevent the soap bar from slipping relative to the soap-holding pad. In one embodiment, the outer strips 32 are about 0.010 to 0.020 inch in thickness, the central strip 36 is about 0.020 inch above the outer strips, and the roughened surface 34 projects about 0.008 to 0.010 inch from the top of the central strip. The suction cups in the normal unflattened condition shown in FIG. 5 project to about the level of the projections on the top surface of the central strip 36. When flattened, the suction cups are level with about the top surface of the central strip so the projections can penetrate the soap bar. The projections on the high friction surface project farther from the pad than the suction cups, in their flattened condition, for enabling the projections to penetrate the soap bar.

Thus, the present invention provides a soap holder which can be adapted to fit all shapes and sizes of soap bars. The soap holder also can be adapted to fit all hand sizes without the need for making any special adjustments in the soap holder itself to fit a particular hand size. The soap holder can be adapted to hold a soap bar in any desired position in the hand of a user, and the soap-holding pad is sufficiently small that the user's hand can grasp the sides of a soap bar to firmly grip the bar of soap. The soap holder can be easily and inexpensively manufactured as a one-piece molded article. The soap holder also can attach to a bar of soap as well as penetrate it so that the bar does not slip relative to the pad during use. The entire soap holder can be made from an inexpensive transparent plastic material so the user can attach the pad to the soap bar so as to avoid embossments or other projections or engraving on the soap so as to straddle same by the rows of suction cups. The embossments or engraving on a new bar of soap need not be shaved off to attach the soap-holding pad of this invention.

I claim:

1. A soap bar holder comprising:
a thin, flexible, elongated soap-holding pad;
a plurality of mutually spaced apart resilient suction cups on a first face of the soap-holding pad;
an elongated, laterally flexible, narrow stem having a first end secured to a second face of the soap-holding pad opposite the first face thereof; and
a stop pad secured to a second end of the stem opposite the first end thereof, the stem having sufficient lateral flexibility to move the soap-holding pad longitudinally and laterally relative to the stop pad.

2. An article according to claim 1 in which the stem is sufficiently flexible that the stop pad can be moved into the plane of the soap-holding pad.

3. An article according to claim 1 in which the soap-holding pad is not more than about ⅛-inch thick, and the first end of the stem is integral with the second face of the soap-holding pad.

4. An article according to claim 3 in which the suction cups are sufficiently resilient that they can flatten out to a thickness of not more than about 0.030 inch when secured to a soap bar.

5. An article according to claim 1 in which the stem is between about one to 1¾ inches long.

6. An article according to claim 1 in which the stem has sufficient structural integrity to remain free-standing when unsupported.

7. An article according to claim 1 including a layer of friction material overlying the first face of the soap-holding pad adjacent the suction cups, the layer of friction material having a roughened surface facing away from the first face of the pad.

8. An article according to claim 7 in which the layer of friction material comprises projections for projecting away from the pad farther than the suction cups in a flattened condition.

9. An article according to claim 7 in which the friction material comprises a flexible mesh strip.

10. An article according to claim 7 in which the layer of friction material is transversely flexible.

11. An article according to claim 1 in which the soap-holding pad and the stop pad are essentially planar, and the plane of the soap-holding pad is substantially parallel to that of the stop pad, and the stem extends substantially perpendicularly between the soap-holding pad and the stop pad.

12. An article according to claim 1 in which the soap-holding pad is no more than about 2 inches long and the width of the soap-holding pad is no greater than its length.

13. An article according to claim 1 in which there are two rows of suction cups on the soap-holding pad, and the rows of suction cups are spaced apart by about 11/16 inch.

14. An article according to claim 1 in which the soap-holding pad, the stem, and the stop pad are formed as an integral piece from the same flexible material.

15. A soap bar holder comprising:
an elongated soap holding pad;
a plurality of mutually spaced apart resilient suction cups of a first face of the soap-holding pad;
an elongated stem secured to a second face of the soap-holding pad opposite the first face thereof;
a layer of friction material overlying the first face of the soap-holding pad adjacent the suction cups, the layer of friction material providing a roughened surface projecting away from the first face of the soap-holding pad farther than the suction cups in a flattened condition; and
a stop pad secured to an end of the stem spaced remote from the soap-holding pad.

16. An article according to claim 15 in which the friction material comprises projections extending away from the pad.

17. An article according to claim 15 in which there are two rows of suction cups on the pad.

18. An article according to claim 17 in which the rows of suction cups are spaced apart by at least about one inch.

19. An article according to claim 17 in which the layer of friction material extends between the rows of suction cups.

20. A soap bar holder comprising:
a thin, flexible, elongated soap-holding pad;
a plurality of mutually spaced apart resilient suction cups on a first face of the soap-holding pad;
a layer of friction material overlying the first face of the soap-holding pad adjacent the suction cups, the layer of friction material comprising projections extending away from the first face of the pad farther than the suction cups in a flattened condition
an elongated, laterally flexible, narrow stem having a first end secured to a second face of the soap-holding pad opposite the first face thereof; and
a stop pad secured to a second end of the stem opposite the first end thereof.

* * * * *